US008596979B2

(12) United States Patent
Care

(10) Patent No.: US 8,596,979 B2
(45) Date of Patent: Dec. 3, 2013

(54) CEILING SWEEP FAN

(75) Inventor: Cristian Victor Care, Connells Point (AU)

(73) Assignee: Martec Pty Ltd., Kingsgrove (AU)

( * ) Notice: Subject to any disclaimer, the term of this patent is extended or adjusted under 35 U.S.C. 154(b) by 572 days.

(21) Appl. No.: 12/866,643

(22) PCT Filed: Jan. 27, 2009

(86) PCT No.: PCT/AU2009/000080

§ 371 (c)(1),
(2), (4) Date: Nov. 15, 2010

(87) PCT Pub. No.: WO2009/097644

PCT Pub. Date: Aug. 13, 2009

(65) Prior Publication Data

US 2011/0064575 A1 Mar. 17, 2011

(30) Foreign Application Priority Data

Feb. 6, 2008 (AU) ..... 2008900555

(51) Int. Cl.
*F04D 25/08* (2006.01)

(52) U.S. Cl.
USPC ..... 416/140

(58) Field of Classification Search
USPC ..... 416/220 A
See application file for complete search history.

(56) References Cited

U.S. PATENT DOCUMENTS

| | | | | |
|---|---|---|---|---|
| 612,598 | A * | 10/1898 | Wanless | 416/220 R |
| 5,440,459 | A * | 8/1995 | Chan | 362/96 |
| 5,797,721 | A | 8/1998 | Yu | |
| 5,944,487 | A | 8/1999 | Pearce | |
| 2007/0036654 | A1 * | 2/2007 | Fedeli et al. | 416/169 R |

OTHER PUBLICATIONS

International Search Report for PCT Application No. PCT/AU2009/000080.
International Preliminary Report on Patentability for PCT Application No. PCT/AU2009/000080.
International Search Report for PCT Application No. PCT/AU2009/000080, Australia, Mar. 6, 2009.
International Preliminary Report on Patentability for PCT Application No. PCT/AU2009/000080, Switzerland, Aug. 10, 2010.

* cited by examiner

*Primary Examiner* — Nathaniel Wiehe
*Assistant Examiner* — Jeffrey A Brownson
(74) *Attorney, Agent, or Firm* — Meyertons, Hood, Kivlin, Kowert & Goetzel, P.C.; Eric B. Meyertons

(57) ABSTRACT

A ceiling sweep fan comprising a rotor supported for axial rotation about upper and lower housings, the rotor supporting a plurality of radially extending fan blades, the upper housing and rotor enclosing an electric motor that drives the rotor; wherein the fan includes stop means to cause the rotor to stop at a fixed position relative to the upper and lower housings.

7 Claims, 7 Drawing Sheets

CEILING SWEEP FAN

BACKGROUND OF THE INVENTION

This invention relates to a ceiling sweep fan.

Ceiling sweep fans traditionally comprise a plurality of spaced radially extending blades which extend from the rotor that is supported about by an upper and lower housing to be suspended by a rod from a ceiling mount. The rotor usually incorporates the rotating component of an electric motor with the remainder of the electric motor namely the stator, being housed in the upper housing. Thus the rotor axially rotates relative to the upper and lower housing. The power to drive the electric motor comes through the ceiling down the suspension rod.

When a ceiling fan is switched off the rotor continues to spin until it gradually comes to rest. Thus the alignment of the rotor with the upper and lower casing is random. It is for this reason that the cross section of the rotor and the upper and lower stators is usually circular so that whenever the fan is stationary the periphery of the rotor and the upper and lower housings are aligned.

This invention is concerned with the design of a ceiling sweep fan wherein the cross section of the rotor and upper and lower housing is not the circular.

SUMMARY OF THE INVENTION

According to the present invention, there is provided a ceiling sweep fan comprising a rotor supported for axial rotation about upper and lower housings, the rotor supporting a plurality of radially extending fan blades, the upper housing supporting an electric motor that drives the rotor; and stop means to cause the rotor to stop at a fixed position relative to the upper and lower housings. Preferably the shape of the exterior of the rotor and upper and lower housings is non circular.

In a preferred embodiment the shape is square.

Preferably, the stop means to cause the rotor to stop in a fixed position relative to the upper and lower housings comprises magnets positioned in the rotor and either the upper and lower housing to cause the rotor, when the power is switched off, to stop with the magnets in alignment.

BRIEF DESCRIPTION OF THE DRAWINGS

An embodiment of the present invention will now be described by way of example only with reference to the accompanying drawings in which.

Figure 1:
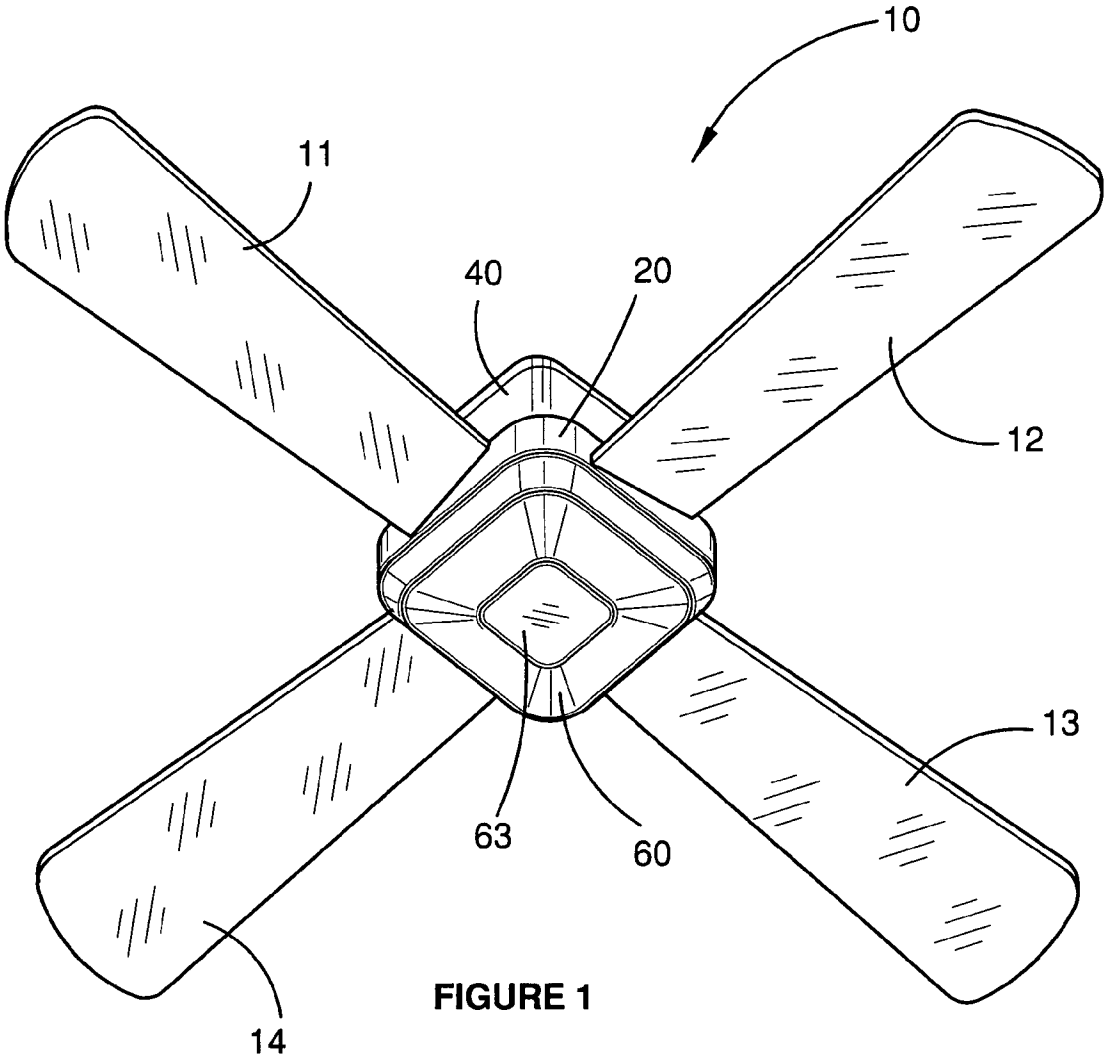
FIG. 1 is an underside perspective view of a ceiling sweep fan.

The ceiling sweep fan 10 illustrated in the accompanying drawings essentially comprises four equally spaced radially extending fan blades 11, 12, 13 and 14 which extend radially from a rotor 20 that is in turn mounted to rotate about an upper housing 40 and lower housing 60. The rotor 20, upper housing 40 and lower housing 60 are secured to a rod 16 that extends vertically to be secured to a ceiling via a ceiling mount (not shown). The rod 16 extends into the ceiling and the entry point is disguised by a cover 18. Although not shown in the drawings, the upper housing 40 supports the stator of an electric motor and the rotor 20 is positioned to rotate relative to the stator once electricity is supplied to the motor.

Figure 2:
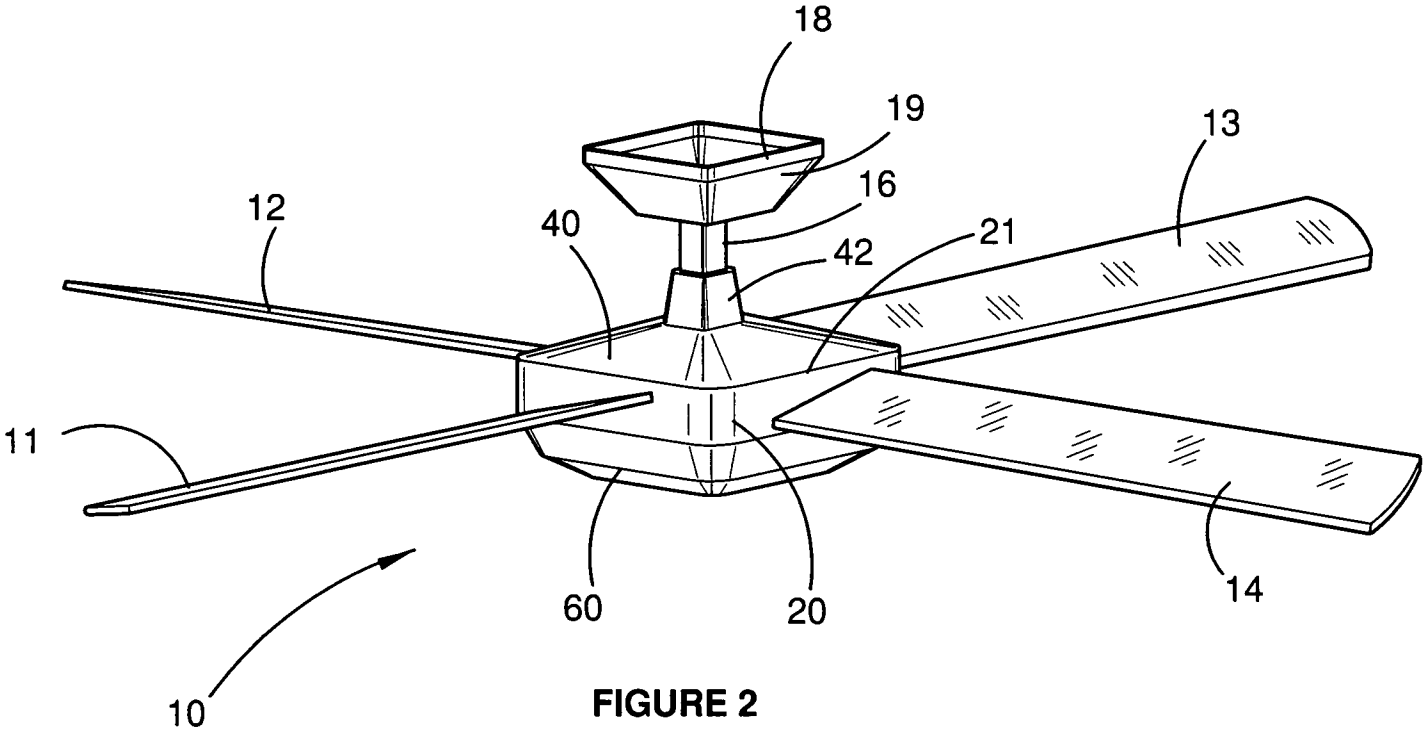
FIG. 2 is a perspective view of the ceiling fan from above.

The cross section of the rotor 20 is essentially a square profile with rounded corners 25 defining four sides 21, 22, 23, 24 of equal length with each side supporting a radially extending blade 11, 12, 13, 14 which extends through an inclined slot 26 to be held to the interior of the rotor 20 by bolts 27. The upper housing 40 is downwardly and outwardly tapered to terminate at its lower edge 41 in a square profile that mirrors the profile of the rotor 20. The upper part of the housing 40 terminates in a spigot 42 of square cross section that fits on to the end of the support shaft 16 which is also of square cross section with rounded edges. The cover 18 which disguises the entry of the shaft 16 into the ceiling is similarly provided in a downwardly and inwardly tapered section 19 of substantially squared profile (FIG. 2).

Figure 3:
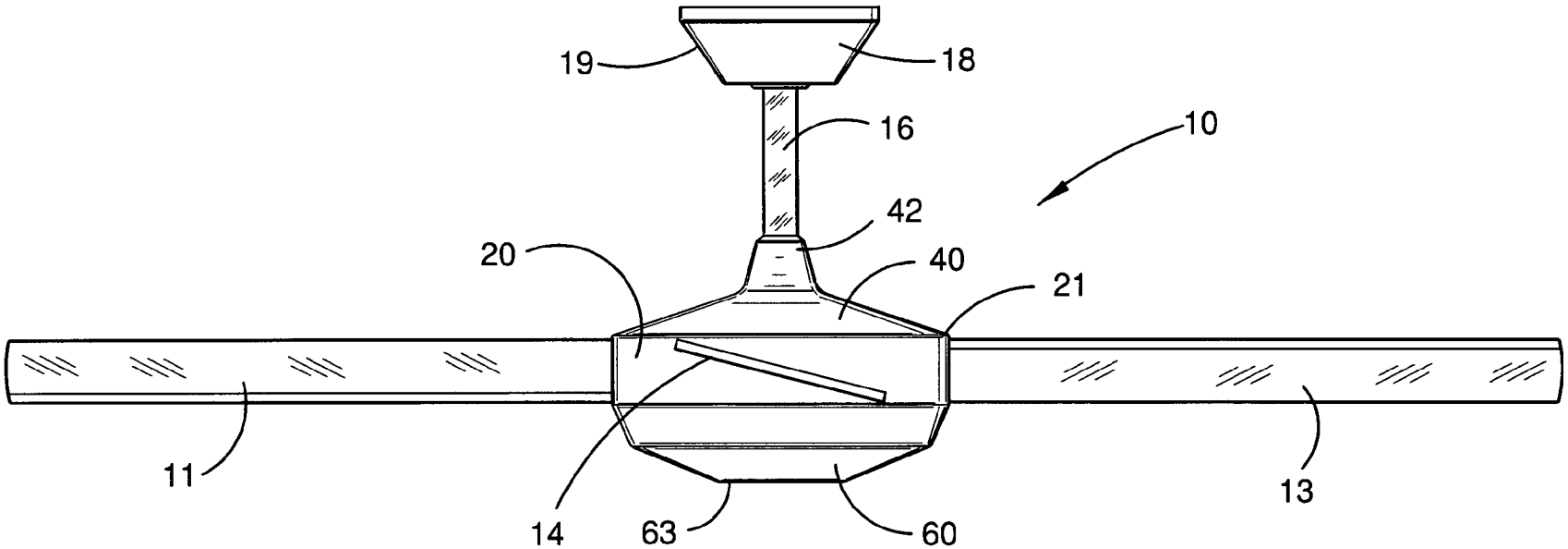
FIG. 3 is a side elevational view of the ceiling fan.
Figure 4:
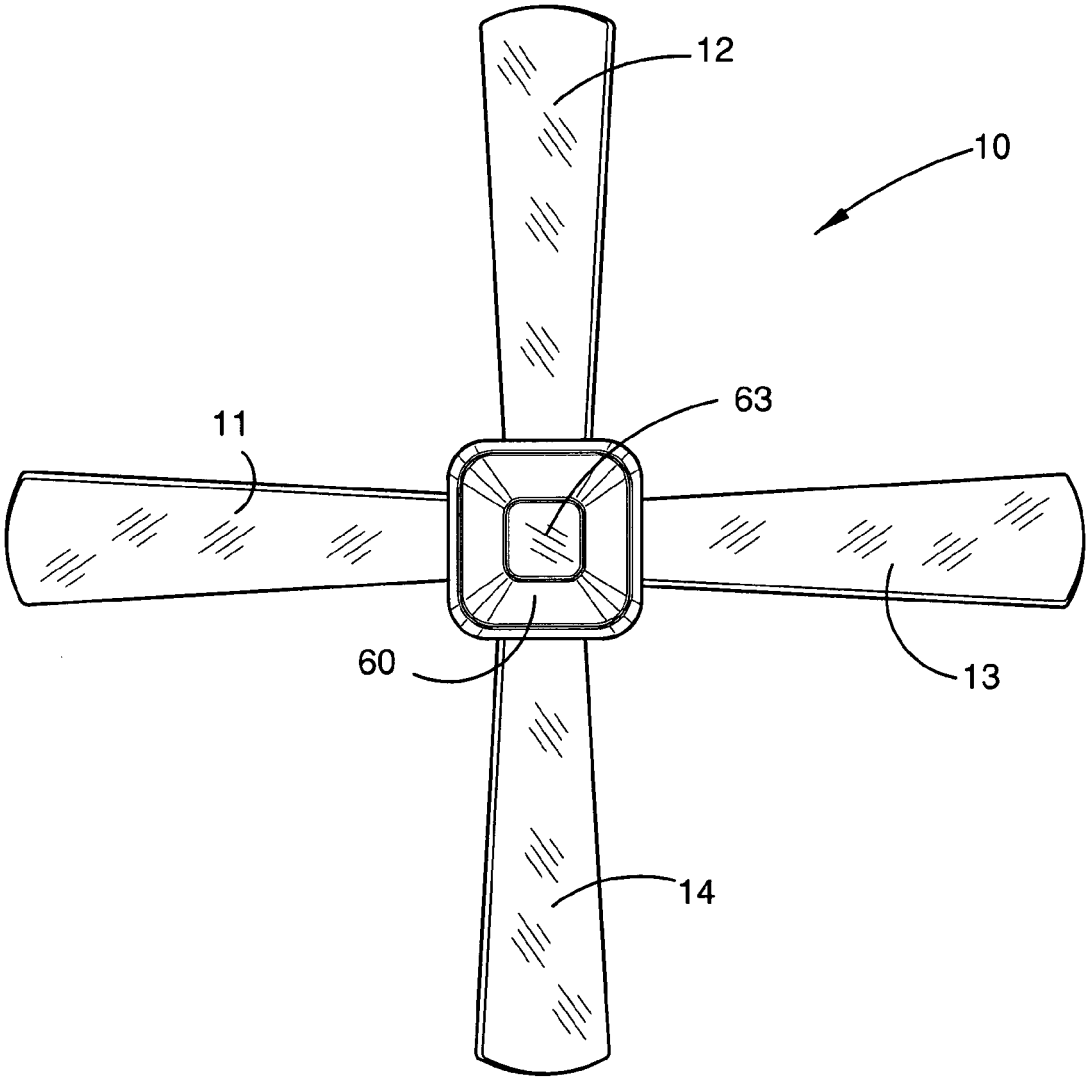
FIG. 4 is an underside view of the ceiling sweep fan.
Figure 5A:
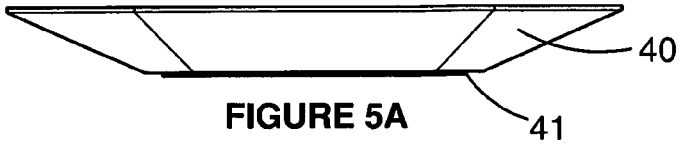
FIGS. 5*a, b* and *c* are side, plan and underside views of an upper housing of the fan.
Figure 5B:
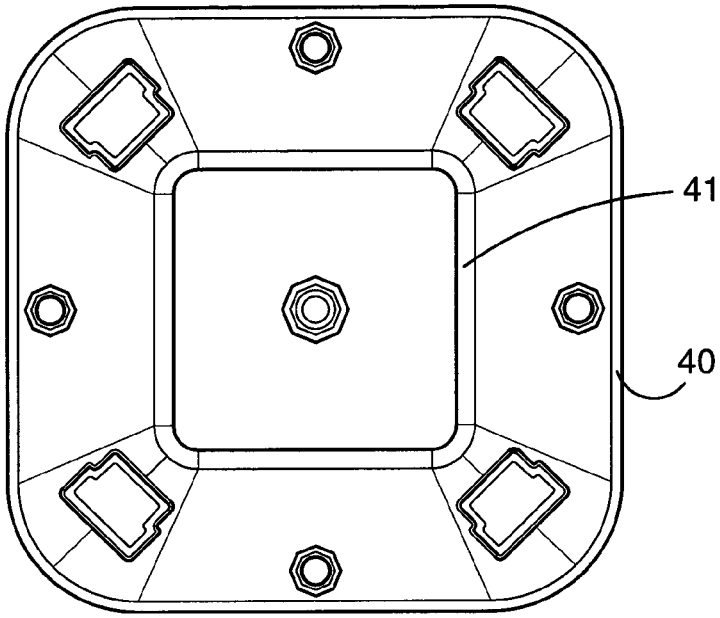
Figure 5C:
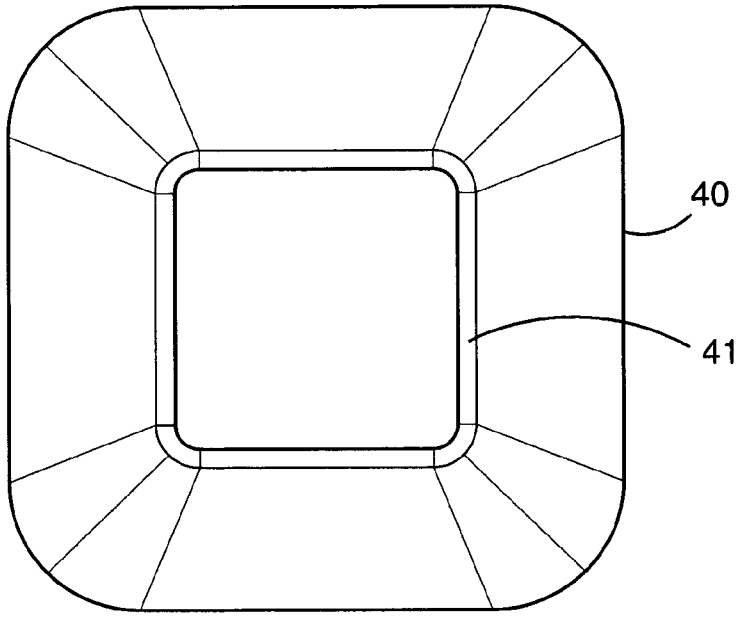

The lower housing 60 has a downwardly and inwardly tapered section 61 of substantially square profile with its upper edge 62 mirroring the profile of the rotor 20 so that, as shown in FIG. 3, when the upper and lower housings 40, 60 are aligned with the rotor 20 they all assume this inline squared profile shown in the drawings. The lower housing 60 may include a light bulb or fluorescent strip with a shade secured across the base of the housing 60. Alternatively the housing can finish in a substantially flat lower plate 63 as shown in FIG. 1.

However, since the rotor 20 and housings 40, 60 are of square profile it is understood that the alignment which is shown in the drawings can only take place if the rotor 20 stops at a predetermined position relative to the upper and lower housings 40, 60.

To ensure that this happens, stop means in the form of permanent magnets are located inside the lower housing 60 and the rotor 20. The magnets are attracted to one another which means, as the power is switched off and the rotor 20 spins freely to a halt, the magnetic attraction causes the rotor 20 to stop at a predetermined position when the cross sections are aligned as shown in the drawings. This gives the fan the elegant closed off look as illustrated and ensures that there is no jagged finish to the alignment of the components.

Figure 6A:
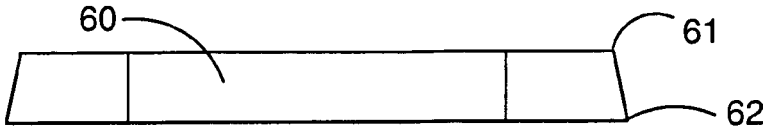
FIGS. 6*a, b* and *c* are side, plan and underside views of a lower housing of the fan.
Figure 6B:
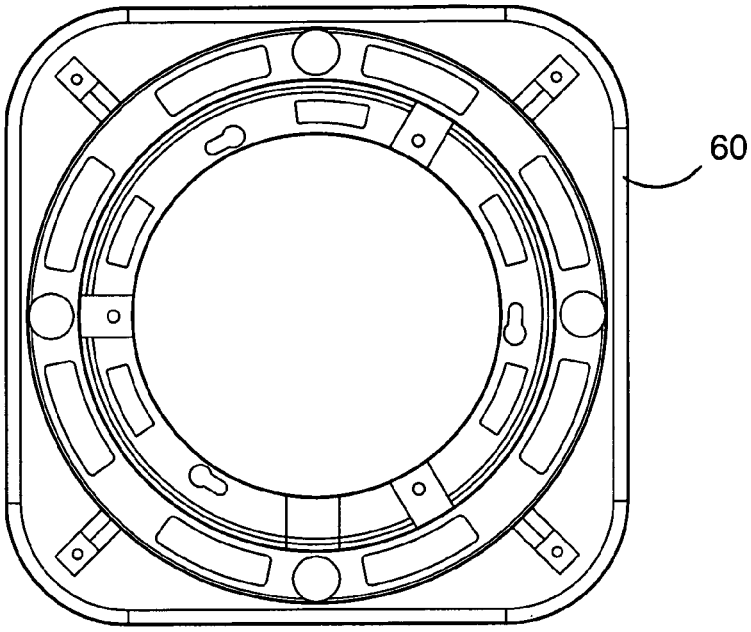
Figure 6C:
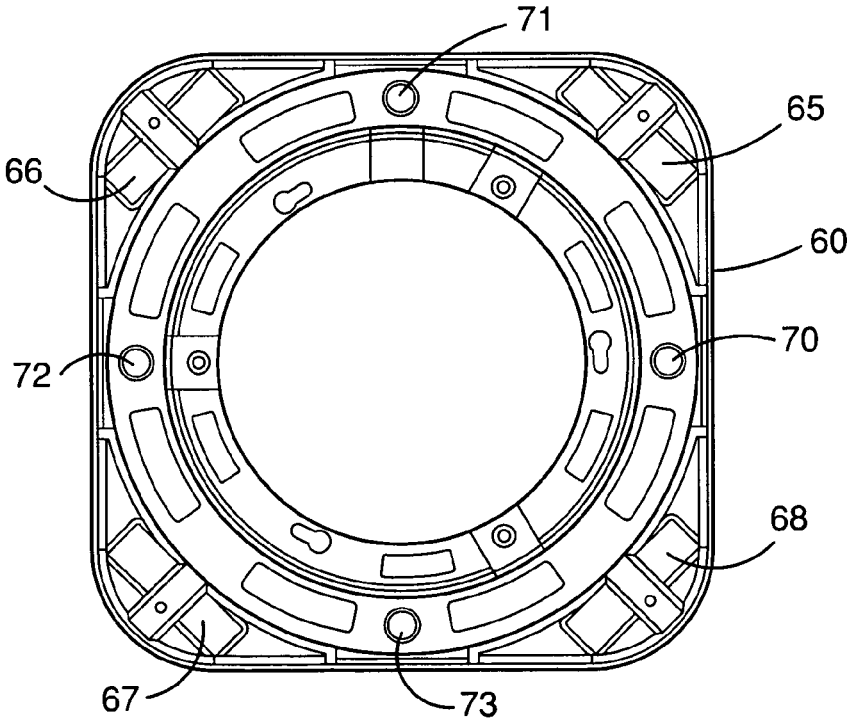
Figure 7A:
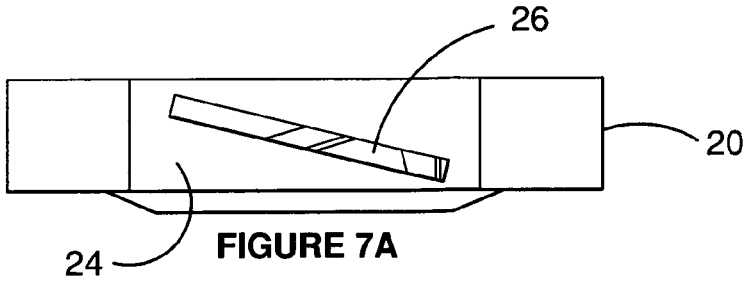
FIGS. 7*a, b* and *c* are side, plan and underside views of a rotor of the fan.
Figure 7B:
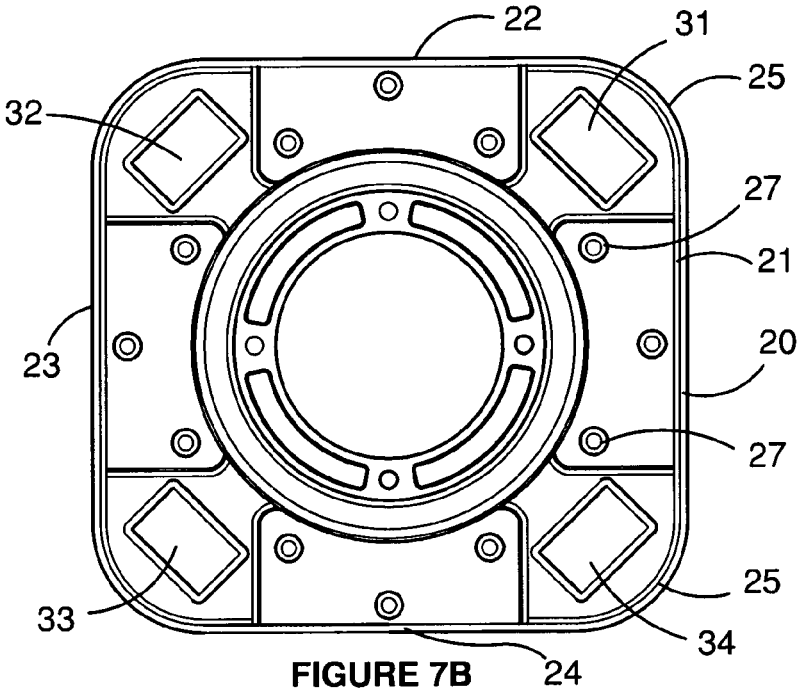
Figure 7C:
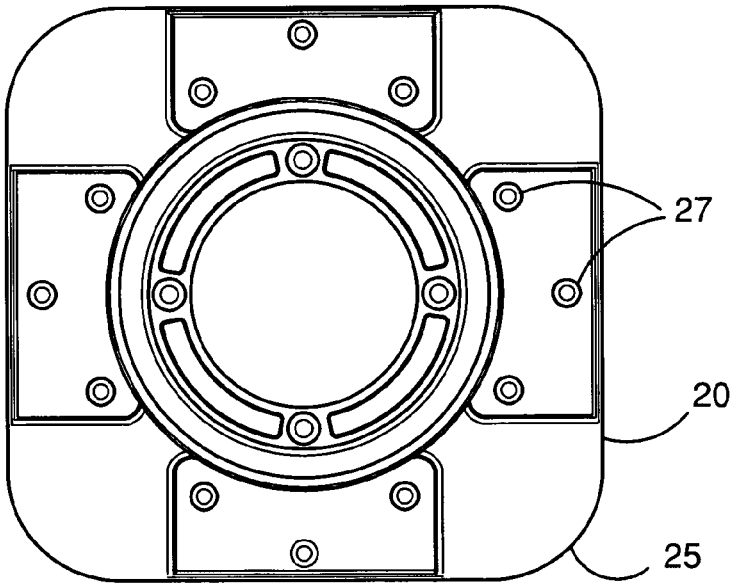

Thus, as shown in FIG. 7*b*, four permanent magnets 31, 32, 33, 34 are located within each corner of the interior of the rotor 20 and as shown in FIGS. 6*a, b* and *c,* four magnets 65, 66, 67, 68 are positioned in each corner of the underside of the lower housing 60. Additionally, four magnets 70, 71, 72, 73 of repelling polarity are positioned midway along the sides of the lower housing 60 (see FIG. 6*c*). As the rotor 20 moves past each corner of the lower housing 60 the magnets 65, 66, 67, 68 attract each other to bring the rotor to a halt with the magnets aligned thus aligning the perimeters of the rotor 20 and lower housing 60. The four additional magnets 70, 71, 72, 73 are positioned at the mid-span of each side of the lower housing 60 to repel the rotor 20 should the corner attempt to stop midway between two adjacent corners on the lower housing. The additional magnets 70, 71, 72, 73 thus ensure that the lower housing 60 and the rotor 20 are always aligned.

The magnets 31, 32, 33, 34 are positioned in the rotor 20 because the rotor casing is preferably aluminium. If, on the other hand, the rotor 20 was magnetically conductive, like steel, there would be no need for the magnets 31, 32, 33, 34.

Although the preferred embodiment has the cross section of the rotor and upper and lower housings of substantially square profile it is understood that any profile is envisaged as long as it has the symmetry to allow the rotor to spin in a balanced configuration. A triangle, pentagon or hexagon are all possible profiles of the components.

Whilst one embodiment has magnets located in both the lower housing and rotor, it is understood that a single magnets could be positioned in one housing to attract the magnetically conductive material of the other component. Furthermore, instead of permanent magnets, a plurality of electro magnets can be utilised. The invention also embraces other forms of stop means.

The claims defining the invention are as follows:

1. A ceiling sweep fan comprising a rotor supported for axial rotation about upper and lower housings, the rotor supporting a plurality of radially extending fan blades, the upper housing and rotor enclosing an electric motor that drives the rotor; wherein the fan includes a stop that causes the rotor to stop at a fixed position relative to the upper and lower housings; wherein the exterior has a square profile defining four corners and when the rotor is in the fixed position relative to the upper and lower housings the corners are aligned.

2. The ceiling sweep fan according to claim 1 wherein the stop is a magnet placed in the rotor or one of the housings to cause the rotor and either housing to assume the fixed position.

3. The ceiling sweep fan according to claim 2 wherein attracting magnets are positioned in the rotor and one of the housings.

4. The ceiling sweep fan according to claim 1 wherein a magnet is positioned in each corner of the rotor or one of the housings.

5. The ceiling sweep fan according to claim 4 wherein a magnet is positioned in each corner of the rotor and one of the housings.

6. The ceiling sweep fan according to claim 5 wherein four magnets of repelling polarity are positioned between the corners of the rotor or either housing to repel the magnet of the other component when in proximity.

7. The ceiling sweep fan according to claim 5 wherein the upper and lower housings and casing of the rotor are made of aluminum.

* * * * *